US009828005B2

(12) United States Patent
Li et al.

(10) Patent No.: US 9,828,005 B2
(45) Date of Patent: Nov. 28, 2017

(54) INTERFACE BREAKDOWN-PROOF LOCOMOTIVE ROOF COMPOSITE INSULATOR

(71) Applicant: BEIJING RAILWAY INSTITUTE OF MECHANICAL & ELECTRICAL ENGINEERING CO., LTD, Beijing (CN)

(72) Inventors: Sha Li, Beijing (CN); Guangdan Liu, Beijing (CN); Leren Wang, Beijing (CN); Xiaoqing Shen, Beijing (CN); Jiangfeng Liu, Beijing (CN)

(73) Assignee: Beijing Railway Institute of Mechanical & Electrical Engineering Co., Ltd., Beijing (CN)

( * ) Notice: Subject to any disclaimer, the term of this patent is extended or adjusted under 35 U.S.C. 154(b) by 0 days.

(21) Appl. No.: 15/108,005

(22) PCT Filed: Jun. 24, 2014

(86) PCT No.: PCT/CN2014/080613
§ 371 (c)(1),
(2) Date: Jun. 24, 2016

(87) PCT Pub. No.: WO2015/176343
PCT Pub. Date: Nov. 26, 2015

(65) Prior Publication Data

US 2016/0325763 A1 Nov. 10, 2016

(30) Foreign Application Priority Data

May 21, 2014 (CN) ..... 2014 1 0216985

(51) Int. Cl.
*H01B 17/26* (2006.01)
*B61C 17/00* (2006.01)
(Continued)

(52) U.S. Cl.
CPC ..... *B61C 17/00* (2013.01); *B61C 3/00* (2013.01); *H01B 17/525* (2013.01); *H01B 17/56* (2013.01); *H01B 17/14* (2013.01)

(58) Field of Classification Search
CPC ..... H01B 17/525; H01B 17/56; H01B 17/14; H01B 17/00; H01B 17/005; H01B 17/02;
(Continued)

(56) References Cited

U.S. PATENT DOCUMENTS 4,212,696 A * 7/1980 Lusk ..... H01B 17/32 174/179
6,051,796 A * 4/2000 Kuhl ..... H01B 17/32 174/177
(Continued)

FOREIGN PATENT DOCUMENTS

CN 1289131 A 3/2001
CN 2886763 Y 4/2007
(Continued)

OTHER PUBLICATIONS

International Search Report dated Feb. 17, 2015, in connection with International patent application No. PCT/CN2014/080613, 4 pages.

*Primary Examiner* — Angel R Estrada
(74) *Attorney, Agent, or Firm* — Duane Morris LLP

(57) ABSTRACT

An interface breakdown-proof locomotive roof composite insulator. The composite insulator comprises: a support body; and at least five shed groups arranged side by side along the axial direction that are provided around the sidewall of the support body, the at least five shed groups includes: at least four shed groups located on the upper end with each group including a large shed and a small shed; and at least one shed group located on the undermost end with each group including two small sheds. For such a shed structure, it is favorable to tolerate impulse voltage, and it is difficult for the interface to be broken down; the electric field
(Continued)

on the interface even does not exceed 3 kV/mm, and even if a gas exists on the interface, it will not break through the interface.

9 Claims, 2 Drawing Sheets

(51) Int. Cl.
*B61C 3/00* (2006.01)
*H01B 17/56* (2006.01)
*H01B 17/52* (2006.01)
*H01B 17/14* (2006.01)

(58) Field of Classification Search
CPC ..... H01B 17/16; H01B 17/26; B61C 17/00; B61C 3/00; B61C 3/02
USPC ..... 174/17 CT, 650, 152 G, 153 G, 152 R, 174/135, 137 R, 138 R, 138 F, 142, 177, 174/176, 179, 137 A, 137 B; 16/2.1, 2.2
See application file for complete search history.

(56) References Cited

U.S. PATENT DOCUMENTS 6,307,157 B1 * 10/2001 Fujii ..... H01B 17/12 174/176
6,657,128 B2 * 12/2003 Ramarge ..... H01B 17/50 174/137 A
7,262,367 B2 * 8/2007 Donzel ..... H01B 17/42 174/137 R
8,319,101 B2 * 11/2012 Adachi ..... H02G 15/064 174/137 R
8,324,504 B2 * 12/2012 Grenier ..... C08L 23/0892 174/137 R
8,383,944 B2 * 2/2013 Takayasu ..... H02G 15/064 174/140 R
8,717,732 B2 * 5/2014 Stenstrom ..... H01C 7/12 174/137 R
8,861,165 B2 * 10/2014 Kampe ..... H01B 17/16 174/142

FOREIGN PATENT DOCUMENTS

| | | | |
|---|---|---|---|
| CN | 2891233 | Y | 4/2007 |
| CN | 201017733 | Y | 2/2008 |
| CN | 201051430 | Y | 4/2008 |
| CN | 201387771 | Y | 1/2010 |
| CN | 201780829 | | 3/2011 |
| CN | 204155675 | U | 2/2015 |
| WO | 03/081610 | A1 | 10/2003 |

* cited by examiner

INTERFACE BREAKDOWN-PROOF LOCOMOTIVE ROOF COMPOSITE INSULATOR

CROSS-REFERENCE TO RELATED APPLICATIONS

The present application is a U.S. national stage application under 35 U.S.C. §371 of PCT Application No. PCT/CN2014/080613, filed Jun. 24, 2014, which claims the benefit of Chinese Patent Application No. 201410216985.1 filed by Beijing Railway Institute of Mechanical & Electrical Engineering Co., LTD on May 21, 2014, titled "Interface breakdown-proof locomotive roof composite insulator", the entireties of which are herein incorporated by reference.

TECHNICAL FIELD

The present disclosure relates to the field of Multiple Units (MUs), in particular, to an interface breakdown-proof locomotive roof composite insulator.

TECHNICAL BACKGROUND

Since the first high-speed railway, Japan New Tokkaido Line, is put into operation on Oct. 1, 1964, high-speed MU has been developed increasingly. After more than 40 years' of continuous development, three high-speed MU technical systems represented by Japan New Tokkaido Line, Germany ICE and France TGV have been basically formed. The MU from each country has respective features according to respective actual demands, and they play a positive role in the development of the word's high-speed railway.

France started to research TGV-PSE since 1976, and it was brought into use in September 1981. In May 1990, TGV-A325 reached a running speed of 515.3 km/h on the Atlantic Line, creating a word record of wheel rail system traveling speed. On Apr. 3, 2007, EMU V150 tested by France reached a trial speed of 574.8 km/h, creating a new record of high-speed railway.

Federal Railways tried to manufacture an ICE intercity fast test vehicle in August 1982. An ICE/V test high-speed EMU, which employed a form of 2 tractors and 3 trailers, was successfully manufactured in 1985, and it reached a trial speed of 317 km/h. In May 1988, ICE/V test train created a speed record of 406.9 km/h in the pathway between Hanoverian and Wuerzburg.

Ministry of Railways of the People's Republic of China purchased high-speed railway vehicle technologies from foreign enterprises such as Bombardier Canada, Kawasaki Heavy Industries, Ltd. Japan, Alstom France and Siemens Germany, etc. and started to develop high-speed trains with a speed of 350 km/h and above by vehicle manufacturing enterprises under China CNR Corporation and China CSR Corporation in a mode of introducing and absorbing overseas advanced technologies since 2004.

As one of the most important devices for vehicle roof line security, the insulator attracts the attention of the operation department and the manufacturing industry of electric locomotives. The fast development of China electric grid accelerates the rapid growth of the composite insulator industry, which brings the Chinese manufacturing technology of silicon rubber composite insulator into a world-leading level.

Generally, the number of composite insulator manufacturing enterprises in China has exceeded 100, but only about 10 of them dominates in the market. In addition, insulator manufacturing enterprises engaging in railway security are even fewer. With the rapid increase of train speed and the wide layout of electrified railways, the operational environment of the locomotive roof insulator is more diversified, and the requirements thereof are stricter. In recent years, insulator flashover and tripping accidents tend to be frequent and serious.

FIG. 1 shows the structure of a locomotive roof composite insulator in the prior art. In such an insulator, although the design of the insulating creepage distance between the shed housing and the shed 12 reaches the standard, i.e., exceeding 1000 mm, the arrangement of the shed goes against impulse voltage tolerance. For composite insulating support insulators, the support body 11 and the shed housing interface are bottle necks for insulation. In this case, the insulation voltage possibly tolerated by these parts should be lowered as much as possible in design, and the longitudinal electric field of the interface should be decreased. Therefore, the existing design needs to be properly modified.

In view of the above problems, there is a need for providing an interface breakdown-proof locomotive roof composite insulator so as to solve the problems of the prior art that the arrangement of the shed goes against impulse voltage tolerance and it tends to cause interface breakdown.

SUMMARY OF THE INVENTION

In an embodiment of the disclosure, it is to provide an interface breakdown-proof EMU locomotive roof composite insulator in which the modified shed structure improves impulse voltage tolerance, and also it prevents the interface from being broken down.

The disclosure employs the following technical solutions.

An interface breakdown-proof EMU locomotive roof composite insulator include: a support body; and at least five shed groups arranged side by side along the axial direction that are provided around the sidewall of the support body, wherein the at least five shed groups includes: at least four shed groups located on the upper end in which each group of the at least four shed groups includes a large shed and a small shed; and at least one shed group located on the undermost end in which each group of the at least one shed group includes two small sheds.

Preferably, the diameter of the large shed is 172 mm-180 mm.

Preferably, the diameter of the small shed is 80 mm-90 mm.

Preferably, the shed pitch between adjacent two sheds is 26 mm.

Preferably, the lower end of the support body is provided with a lower fitting, and the lower fitting is provided with a creepage distance increasing shed.

Preferably, the diameter of the creepage distance increasing shed is 80 mm-90 mm.

Preferably, the creepage distance increasing shed is vulcanized on the lower fitting.

Preferably, the diameter of the large shed is 176 mm.

Preferably, the diameter of the small shed is 86 mm.

The disclosure has the beneficial effects below:

1) In the interface breakdown-proof locomotive roof composite insulator provided in the disclosure, at least five shed groups arranged side by side along the axial direction are provided around the sidewall of the support body, and the at least five shed groups includes: at least four shed groups located on the upper end in which each group includes a large shed and a small shed; and at least one shed group located on the undermost end in which each group includes two small sheds, so that for the modified shed structure improves the impulse voltage tolerance, and also it prevents the interface from being broken down. Further, the electric field on the interface even does not exceed 3 kV/mm after modification, and even if a gas exists on the interface, it will not break through the interface.

2) The ccreepage distance increasing shed is provided on the lower fitting of the lower end of the support body, so that the arcing distance and the insulator creepage distance can be increased greatly without adding the height of the insulator, thus solving the problem for discharging the lower shed edge of the insulator on the base plate, and hence the insulator has a bigger insulation margin, and is more secure and reliable.

Wherein:

11: Support body; 12: Shed; 13: Upper Fitting; 14: Lower Fitting;

21: Support body; 22: Shed; 23: Upper Fitting; 24: Lower Fitting; 26: creepage distance increasing shed Skirt

DETAILED DESCRIPTION OF THE PREFERRED EMBODIMENT

The technical solutions of the disclosure will be further illustrated in detail below in conjunction with the drawings and specific embodiments.

Figure 2:
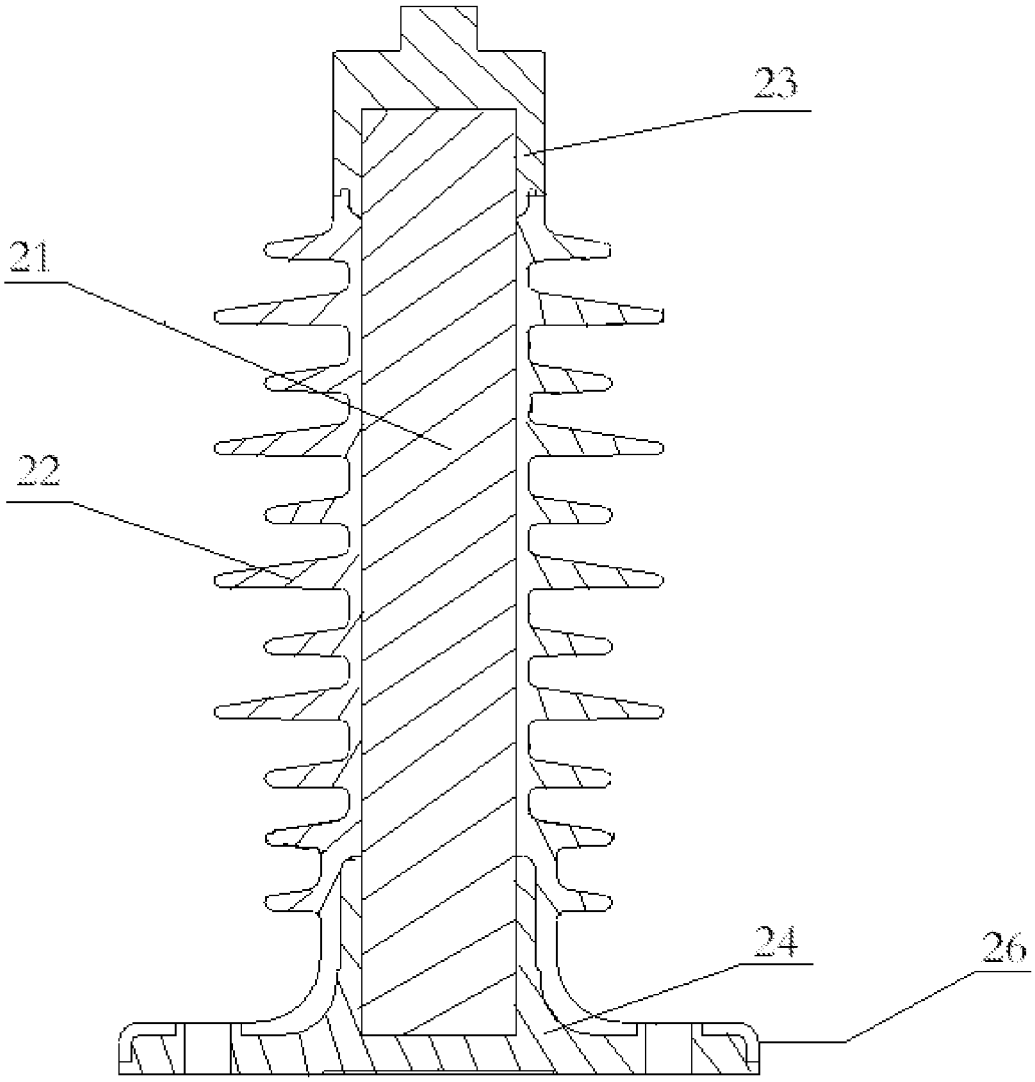
FIG. 2 is a sectional view of an interface breakdown-proof EMU locomotive roof composite insulator according to an embodiment of the disclosure.

In view of the problems in the prior art, an embodiment of the disclosure provides a composite insulator of which the structure is as shown in FIG. 2. The interface breakdown-proof EMU locomotive roof composite insulator includes: a support body 21; and at least five shed groups 22 arranged side by side along the axial direction that are provided around the sidewall of the support body 21, wherein, the at least five shed groups includes: at least four shed groups 22 located on the upper end with each group including a large shed and a small shed; and at least one shed group 22 located on the undermost end with each group including two small sheds.

In this embodiment, preferably, the diameter of the large shed is 172 mm-180 mm.

In this embodiment, preferably, the diameter of the small shed is 80 mm-90 mm.

In this embodiment, preferably, the shed pitch between adjacent two sheds is 26 mm.

In this embodiment, preferably, the diameter of the large shed is 176 mm.

In this embodiment, preferably, the diameter of the small shed is 86 mm.

The minimum insulating strength of the interface of the locomotive roof composite insulator in this application will be calculated below as compared with the minimum insulating strength of the interface of the locomotive roof composite insulator in the prior art.

Figure 1:
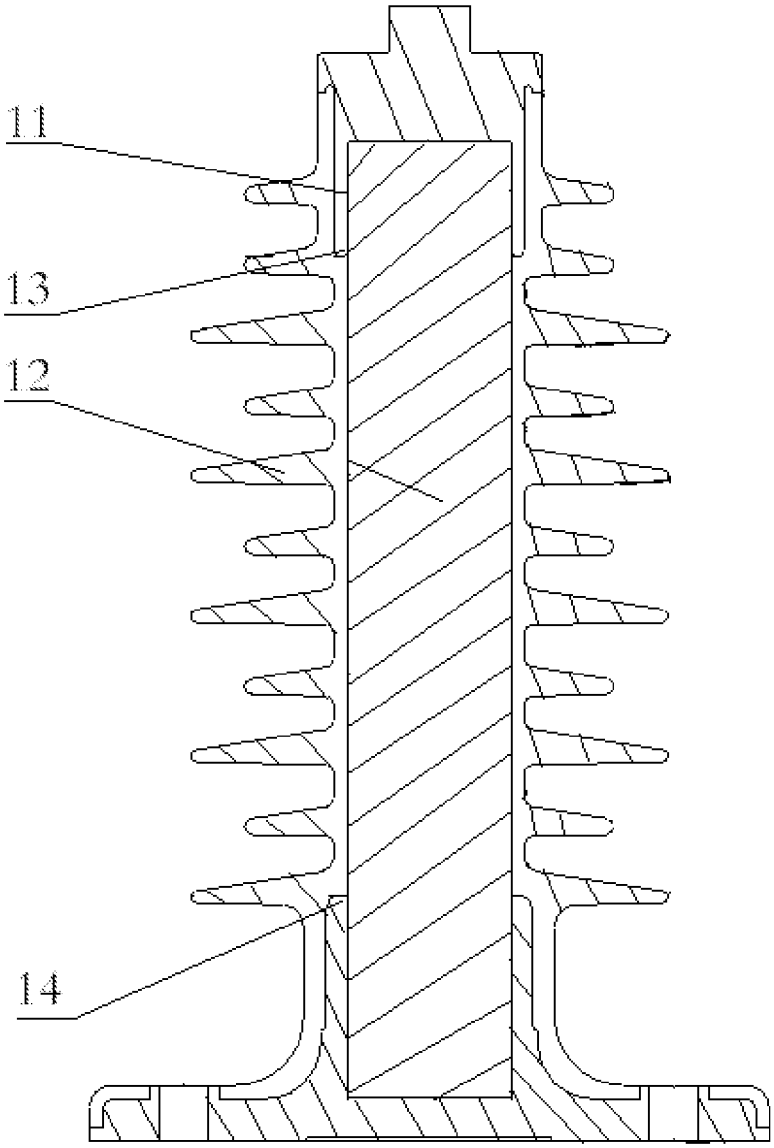
Prior Art Figure 1
FIG. 1 is a sectional view of an EMU locomotive roof composite insulator in the prior art.

FIG. 1 is a sectional view of a locomotive roof composite insulator in the prior art. The electric field strength of the support body 11 and the shed housing interface under the action of a possible impulse voltage is calculated according to the structure of the insulator. According to the test requirements, in calculation, the steep wave voltage is taken as 500 kV, the minimum thickness of the shed housing is taken as 4.5 mm, and the insulation level is taken as 30 kV/mm, so that the breakdown voltage is 30 kV/mm×4.5 mm=135 kV. The pitch between the upper fitting 13 and the lower fitting 14 is taken as 235 mm, so that the average electric field is 500 kV/235 mm=2.13 kV/mm. The minimum insulation voltage required by each interface can be shown by the calculation results 1-6.

1) Calculation of heel insulating strength of the $2^{nd}$ shed

The minimum insulating strength of the interface thereof is: 91 kV/10 mm=9.1 kV/mm.

2) Calculation of heel insulating strength of the $3^{rd}$ shed

The minimum insulating strength of the interface thereof is: 197 kV/34 mm=5.8 kV/mm.

3) Calculation of heel insulating strength of the $4^{th}$ shed

The minimum insulating strength of the interface thereof is: 227 kV/62 mm=3.7 kV/mm.

4) Calculation of heel insulating strength of the $5^{th}$ shed

The minimum insulating strength of the interface thereof is: 308 kV/87 mm=3.5 kV/mm.

5) Calculation of heel insulating strength of the last one shed

The minimum insulating strength of the interface thereof is: 75 kV/10 mm=7.5 kV/mm.

6) Calculation of heel insulating strength of the last but one shed

The minimum insulating strength of the interface thereof is: 100 kV/36 mm=2.8 kV/mm.

FIG. 2 shows the external form of a modified EMU locomotive roof composite insulator in the disclosure. The pitch between an upper fitting 23 and a lower fitting 24 is 250 mm, so that the average electric field is 500 kV/250 mm=2 kV/mm. The minimum insulation voltage required by each interface is as shown by the calculation results 7-11.

7) Calculation of heel insulating strength of the $1^{st}$ shed

The minimum insulating strength of the interface thereof is: 1 kV/20 mm=0.05 kV/mm.

8) Calculation of heel insulating strength of the $2^{nd}$ shed

The minimum insulating strength of the interface thereof is: 105 kV/46 mm=2.3 kV/mm.

9) Calculation of heel insulating strength of the $3^{rd}$ shed

The minimum insulating strength of the interface thereof is: 133 kV/72 mm=1.8 kV/mm.

10) Calculation of heel insulating strength of the last one shed

The minimum insulating strength of the interface thereof is: 36 kV/17 mm=2.1 kV/mm.

11) Calculation of heel insulating strength of the last but one shed

The minimum insulating strength of the interface thereof is: 76 kV/40 mm=1.9 kV/mm.

As comparing the electric field of the shed housing interface of the modified insulator near the high-voltage side fitting with the prior art, it decreases from 9.1 kV/mm to 0.05 kV/mm in the first group by 99%, it decreases from 5.8 kV/mm to 2.3 kV/mm in the second group by 60%, and it decreases from 3.7 kV/mm to 1.8 kV/mm in the third group by 51%. As comparing the electric field of the shed housing interface of the modified insulator near the low-voltage side fitting with the prior art, it decreases from 7.5 kV/mm to 2.1 kV/mm in the fourth group by 72%, and it decreases from 2.8 kV/mm to 1.9 kV/mm in the fifth group by 32%.

More preferably, the electric field of each of the modified interfaces does not exceed 3 kV/mm, and even if a gas is present on the interface, the interface will not be broken through.

In this embodiment, for the problem of discharging between the lower shed edge of the locomotive roof composite insulator and the lower fitting 24 thereof under an extreme climate, if the creepage distance still needs to be increased, a creepage distance increasing shed 26 may be provided on the lower fitting 24 of the lower end of the support body 21.

The arcing distance and the insulator creepage distance can be increased greatly without adding the height of the insulator, thus solving the problem of discharging the lower shed edge of the insulator on the base plate, and hence the insulator has a bigger insulation margin, and is more secure and reliable.

In this embodiment, preferably, the creeping distance increasing shed 26 has a separate structure with the lower fitting 24, and is mounted to the lower fitting 24 during operation; however, the steep wave test will not be affected if creeping distance increasing shed 26 is not included in the original configuration. More preferably, the creepage distance increasing shed 26 is made of a thermal shrinkage material.

In this embodiment, preferably, the creepage distance increasing shed 26 is vulcanized on the lower fitting 24.

In this embodiment, preferably, the diameter of the creepage distance increasing shed 26 is 80 mm-90 mm.

In this embodiment, preferably, the support body 21 is a high-strength glass fiber epoxy resin bar.

The support body 21 is the framework of the composite insulator. Since a high-strength glass fiber epoxy resin bar is employed as the support body 21 in this embodiment, a good acid resistance and high flexural resistance can be obtained, and the flexural resistance is greater than 16 kN.

The novel material is formed by winding the, glass fiber which is soaked with epoxy resin under a high temperature, and under the mechanical stress, the electric stress and the chemical action of sulphur hexafluoride and the resolvents thereof at the same time, the moisture in the atmosphere may enter due to design deficiency and quality defect, etc., so that the glass fiber-enhanced epoxy resin tube may be deteriorated. Moreover, the expansion coefficient of the glass fiber-enhanced epoxy resin tube approaches zero, and the expansion coefficient of the metal accessories is $0.26\times10^{-6}$, and hence the difference therebetween is very small. However, gas seizes every opportunity. In order to guarantee the reliability and security of the insulator during long-term outdoor operation, it should ensure reliable interface joint and sealing between the end accessories, the glass fiber-enhanced epoxy resin tube and the shed housing in designing and manufacturing.

In this embodiment, the upper end of the support body 21 is provided with an upper fitting 23 for connecting a conducting rod, and the upper fitting 23 is assembled on the upper end of the support body 21 via high-pressure crimping connection.

Moreover, the lower end of the support body 21 is provided with a lower fitting 24 for mounting the composite insulator onto the locomotive roof, and the lower fitting 24 is assembled on the lower end of the support body 21 via high-pressure crimping connection.

Specifically, the upper end and the lower end of the support body 21 are respectively provided with an upper end opening and a lower end opening, into which the upper fitting 23 and the lower fitting 24 are respectively inserted, thereby being assembled on the two ends of the support body 21.

In this embodiment, since the fittings located on the upper and lower ends of the support body 21 are both assembled using high-pressure crimping, the composite insulator is bending-resistant and tight, and has good shock resistance, shock resistance and brittle failure resistance, the bending resistance thereof is greater than 16 kN, and it can operate under various climates, operating conditions and environments.

In this embodiment, preferably, the upper fitting 23 is made of stainless steel 304.

In this embodiment, preferably, the lower fitting 24 is also made of stainless steel 304.

In this embodiment, preferably, the shed 22 is made of silicon rubber material.

The silicon rubber has the characteristics of low surface energy, high hydrophobicity and hydrophobic mobility, etc., thus having a very good pollution flashover resistance. The number of carbon atoms in the molecule of silicon rubber is less than that of an organic polymer, thus having a very good arc resistance and electric leakage resistance. Additionally, even if the silicon rubber is burned, it would form insulating silicon, thus having an excellent electric insulativity.

Due to the high bond energy and good chemical stability of the silicon rubber, it has a better heat tolerance than organic polymers. Moreover, due to the poor inter-molecule interaction force, the vitrification temperature is low, and the cold tolerance is good. Therefore, the characteristics will not be changed no matter where it is used. Because a methyl group is present on the surface of polysiloxane, it has hydrophobicity, thereby using in waterproof. The insulator employs a high-quality silicon rubber as its external insulating material, and hence it has acid resistance, alkali resistance and saline resistance, and has excellent atmosphere aging resistance and ultraviolet aging resistance. It has a good temperature practicability and a high-temperature resistance, and may work at 100° C.; moreover, it has a low-temperature resistance, and may still keep elasticity at −60° C.

In this embodiment, preferably, the shed 22 is located on the outside of the shed housing. In order to eliminate the hidden danger to internal insulation due to bonding and improve the internal insulating strength, the shed 22 and the shed housing should be formed integrally.

The insulator has the advantages of light mass, small volume, easy transportation and installation, high mechanical strength and good soiling resistance; and is also free-cleaning and without preventative test during operation, thus avoiding pollution flashover accident so that it is especially applicable for moderate and serious polluted regions. In addition, a creepage distance increasing shed is used in the disclosure, so that the arcing distance of the insulator is effectively prolonged without adding the height of the insulator, and hence it is a novel insulator totally different from porcelain insulators in terms of the material and the structure. It has the advantages of reasonable structure and good high-speed performance. The insulator has passed the 380 km/h wind-tunnel test made by the low-speed aerodynamic research institute of Chinese aerodynamic research & development center, so that it is applicable for CRH3 series EMU group.

The technical principles of the invention have been described above in conjunction with specific embodiments. These descriptions are only used for explaining the principles of the invention, rather than limiting the protection scope of the invention in any way. Based on the explanation, one skilled the art may obtain other specific embodiments of the invention without creative work, and these embodiments all fall into the protection scope of the invention.

The invention claimed is:

1. An interface breakdown-proof locomotive roof composite insulator, comprising: a support body; and at least five shed groups arranged side by side along an axial direction that are provided around a sidewall of the support body, wherein, the at least five shed groups includes: at least four shed groups located on an upper end in which each group of the at least four shed groups comprises a large shed and a small shed; and at least one shed group located on an undermost end in which each group of the at least one shed group comprises two small sheds.

2. The interface breakdown-proof locomotive roof composite insulator according to claim 1, wherein, a diameter of the large shed is 172 mm-180 mm.

3. The interface breakdown-proof locomotive roof composite insulator according to claim 2, wherein, a diameter of the small shed is 80 mm-90 mm.

4. The interface breakdown-proof locomotive roof composite insulator according to claim 3, wherein, a shed pitch between adjacent two sheds is 26 mm.

5. The interface breakdown-proof locomotive roof composite insulator according to claim 1, wherein, a lower end of the support body is provided with a lower fitting, and the lower fitting is provided with a creepage distance increasing shed.

6. The interface breakdown-proof locomotive roof composite insulator according to claim 5, wherein, a diameter of the creepage distance increasing shed is 80 mm-90 mm.

7. The interface breakdown-proof locomotive roof composite insulator according to claim 5, wherein, the creepage distance increasing shed is vulcanized on the lower fitting.

8. The interface breakdown-proof locomotive roof composite insulator according to claim 2, wherein, a diameter of the large shed is 176 mm.

9. The interface breakdown-proof locomotive roof composite insulator according to claim 3, wherein, the diameter of the small shed is 86 mm.

* * * * *